United States Patent [19]

Lebedev

[11] Patent Number: 5,000,517

[45] Date of Patent: Mar. 19, 1991

[54] POWERED MEMBER FOR SPLITTING ROCK AND OTHER BODIES

[75] Inventor: Jury A. Lebedev, Gorno-Altaisk, U.S.S.R.

[73] Assignee: Gorno-Altaisky Gosudarstvenny Pedagogichesky Institut, Gorno-Altaisk, U.S.S.R.

[21] Appl. No.: 457,829

[22] PCT Filed: Apr. 18, 1989

[86] PCT No.: PCT/SU89/00101

§ 371 Date: Jan. 18, 1990

§ 102(e) Date: Jan. 18, 1990

[87] PCT Pub. No.: WO89/11023

PCT Pub. Date: Nov. 16, 1989

[30] Foreign Application Priority Data

May 6, 1988 [SU] U.S.S.R. ..... 4413719

[51] Int. Cl.[5] ..... E21B 37/04; E21B 37/06

[52] U.S. Cl. ..... 299/21; 299/23

[58] Field of Search ..... 299/20, 21, 23; 166/187; 269/48.1, 48.3; 29/113.1

[56] References Cited

U.S. PATENT DOCUMENTS

| | | | |
|---|---|---|---|
| 1,808,162 | 6/1931 | Frantz | 29/113.1 X |
| 3,572,840 | 3/1971 | Fletcher | 299/23 |
| 4,168,862 | 9/1979 | Langfield | 299/23 |
| 4,690,460 | 9/1987 | Lebedev | 299/21 |
| 4,871,212 | 10/1989 | Lebedev | 299/21 |

FOREIGN PATENT DOCUMENTS

| | | |
|---|---|---|
| 1059173 | 8/1983 | U.S.S.R. . |
| 1033829 | 12/1983 | U.S.S.R. . |

*Primary Examiner*—Ramon S. Britts
*Assistant Examiner*—David J. Bagnell
*Attorney, Agent, or Firm*—Lilling and Lilling

[57] ABSTRACT

In a powered member, a device for attaching each end of a flexible tubular chamber to a head of a nipple is formed by a pair of cylindrical bushings interconnected by means of a tenon and mortise joint which are located in the casing and define a central passage having its axis aligned with the axis of the casing. Walls of the passage in a plane drawn in parallel with the longitudinal axis of the casing are in the form of a pair of truncated cones having their larger bases facing towards each other. One generatrix of the conical surface of the passage extends substantially in parallel with generatrix of one conical passage of the head of the nipple and the other generatrix of the passage extends substantially in parallel with the generatrix of the other conical passage of the head of the nipple.

2 Claims, 1 Drawing Sheet

POWERED MEMBER FOR SPLITTING ROCK AND OTHER BODIES

BACKGROUND OF THE INVENTION

1. Field of the Invention

The invention relates to the mining industry, and more specifically, it deals with a powered member.

The invention may be most advantageously used for stripping off large-size blocks of natural stone along a line of boreholes and for their subsequent splitting into blocks, for non-explosive driving of mining workings in rocks, or for demolishing foundations of old buildings and other structures. A powered member according to the invention when used in boreholes may find application for weakening difficult to break roof in working sheet deposits, for positive degassing of coal seams, fracturing oil and gas formations, for investigations into stress-strain state of a rock mass under field conditions and as a powerful small-size drive for actuator members of presses, jacks, guillotines and other devices where considerable directional forces should be developed.

2. Description of the Related Art

Hydraulic splitters are now widely used in the mining industry, and their construction has practically exhausted any possibility of further increase in a directive force developed by the splitters without an increase in weight and size.

In addition, the fact that the drive of a hydraulic splitter is located outside a borehole also results in an increase in weight of the hydraulic splitter because of the need to increase thickness of walls of the hydraulic splitter upon an increase in pressure in its hydraulic system.

The fact that a working member of the hydraulic splitter is disposed only in the mouth portion of a borehole substantially limits the field of application of hydraulic splitters and maximum splitting force as the directional propagation of a fracture is only possible in the immediate vicinity to the working member, and a concentration of load at the mouth of the borehole may cause surface spalling of a block rather than the formation of a predetermined splitting plane.

The provision of a radically new design of a powered member (SU, A, 1033829) has made it possible to achieve an increase in a directional splitting force.

Known in the art is a powered member having an axially parting casing accommodating a coaxially mounted flexible tubular chamber and a pair of spacer inserts each located on the casing parting line side. The insert is trapezoidal in section by a plane perpendicular with respect to the casing axis, the larger base of the trapezium bearing against the flexible chamber and the sides bearing against the inner wall of the casing. In addition, the powered member has a pair of rings, each having a nipple designed for supplying fluid to the interior of the flexible chamber. Each end of the flexible chamber is disposed between the nipple and ring. A perforated tubular core is provided to extend in the interior of the flexible chamber along the longitudinal axis thereof. Each end of the core is made in the form of a nipple. Each ring is in the form of a bushing having an inner thread coupled to an outer thread of the nipple. The rings are thus rigidly secured to each other by means of the tubular core. The rings are designed for sealing the ends of the flexible chamber.

When fluid under pressure is supplied to the interior space of the flexible chamber, the parts of the casing are tensioned under the action of both flexible chamber and spacer inserts. The prior art powered member is deficient in a low efficiency.

The efficiency here means the ratio of a force developed by the powered member in a predetermined direction to a force developed by the flexible chamber. For that reason the powered member has not found widespread use for splitting blocks of natural rock such as granite from the rock mass because of a limited force developed by the flexible chamber, e.g. 10 MPa. It is for this reason that the powered member could not develop the necessary force in a predetermined direction, i.e. perpendicularly with respect to the splitting plane. This is due to the fact that substantial axial loads developing in the tubular core cause its tension. This results in a clearance forming between the end face of the casing and the end face of each of the rings facing towards the flexible chamber. The material of the flexible chamber "flows out" into this clearance and is then broken. In addition, the tension of the core causes the loss of sealing of the ends of the flexible chamber which results in leakages of fluid. The elongation of the core may be reduced by increasing its cross-sectional area. This, however, results in a substantial increase in size and metal usage of the powered member or in a decrease in the workstroke of the movable parts of the casing and an increase in specific pressure at the point of engagement of the lateral faces of the inserts with the inner surface of the casing if the size remains unchanged which is undesirable because it would call for the employment of special materials and lubricants. It should be also noted that the trapezoidal configuration of the spacer inserts is not an optimum one because with a non-uniform pressure of the parting halves of the casing against the surface of the borehole a clearance is formed between the lateral face of each insert and the inner surface of the casing so that the material of the flexible chamber can "flow out" into this clearance.

The need to increase fluid pressure in the flexible tubular chamber to develope an increased directional splitting force resulted in the provision of a powered member disclosed in U.S. Pat. No. 4,690,460.

This prior art powered member comprises an axially parting casing accommodating a coaxially mounted tubular flexible chamber. The casing accommodates spacer inserts each located on the casing parting line side in a plane perpendicular with respect to the casing axis and having a trapezoidal cross-section with the larger base of the trapezium bearing against the flexible chamber and the sides bearing against the inner walls of the casing. A pair of nipples are provided for supplying fluid to the interior space of the flexible chamber and for air escape therefrom, which are located on the side of the end faces of the casing for movement along the longitudinal axis thereof, and a means for attaching each end of the flexible chamber to a head of the nipple. The means for attaching each end of the tubular flexible chamber to the nipple head comprises a bushing which is rigidly secured to a ring having a central passage for receiving the nipple which has its cylindrical portion conjugated with a conical portion having a generant inclined with respect to the longitudinal axis of the bushing at an angle corresponding to the angle of inclination of a conical surface of the nipple head, the generant of a conical surface of the ring being inclined with respect to the longitudinal axis of the ring at an angle corresponding to the angle of inclination of another conical surface of the nipple.

This construction of a powered member makes it possible to enlarge its field of application, e.g. for a non-explosive splitting of large-size blocks of hard natural stone, for fracturing boreholes in rock masses with the aim of evaluating the stress state of the earth crust, prevention of "rock shocks", and the like owing to an increase in maximum directional force developed by the powered member which is achieved by the casing of the powered member taking up the axial force which is the longitudinal component of fluid pressure in the flexible chamber. As the parting halves of the casing take up substantial axial forces during operation of the powered member, a prestressed design of the powered member is thereby provided. This rules out plastic deformation in the casing thereby enhancing reliability and prolonging life of the powered member. Reliability of the powered member in operation is enhanced owing to an increase in its axial rigidity with a substantial increase in fluid pressure in the flexible chamber since microclearances between the casing and flanges of the rings forming under high pressures become smaller. In addition, these microclearances are compensated for by the expansion of elastic members surrounding the tubular flexible chamber, each elastic member being received in an annular groove provided in the inner surface of the casing. Each elastic member engages the end face of the ring, surface of the annular groove and end face of the spacer insert. This rules out "flow-out" of the material of the flexible chamber into the spaces, hence, substantially enhances reliability of the powered member in operation with high fluid pressures in the flexible chamber which may be in excess of 100 MPa.

This construction of the powered member, is, however, characterized by a limited stroke of the parting halves of the casing so as to lower capacity of the powered member, reduce directiveness of the splitting force and increase the length of the powered member, hence its weight.

SUMMARY OF THE INVENTION

The invention is based on the problem of providing a powered member in which a means for attaching the ends of a flexible tubular chamber is so constructed as to enhance reliability in operation with an increase in the directional splitting force developed by the powered member.

The above problem is solved by a powered member comprising an axially parting casing accommodating a coaxially mounted flexible tubular chamber, spacer inserts, each being located on the side of the parting plane of the casing and in a plane perpendicular with respect to the axis of the casing, having a trapezoidal cross-section with a larger base of the trapezium bearing against the flexible chamber and the sides bearing against the inner surface of the casing wall, a pair of nipples for supplying fluid to the interior of the flexible chamber and for air escape therefrom provided on the side of the end faces of the casing for movement along the longitudinal axis of the casing, and a means for attaching each end of the flexible tubular chamber to a nipple head. According to the invention, the means for attaching each end of the flexible chamber to the nipple head comprises a pair of cylindrical bushings interconnected by means of a tenon and mortise joint, received in the casing and defining a central passage having its axis aligned with the axis of the casing, the walls of the passage in a plane drawn in parallel with the longitudinal axis of the casing having the configuration of two truncated cones having their larger bases facing towards each other, one generatrix of the conical surface of the passage extending substantially in parallel with the generatrix of one conical surface of the nipple head and the other generatrix of the passage extending substantially in parallel with another generatrix of the conical surface of the nipple head.

This construction of the powered member results in reduced size and metal usage owing to the accommodation of the means for attaching the end of the flexible chamber in an annular groove provided in the inner surface of each half of the parting casing. The construction of the powered member according to the invention makes it possible to dispense with a number of parts, namely, with elastic conical rings, washers and rings. The end face of each of the bushings prevents an annular microclearance from forming between the end faces of the spacer inserts and parting halves of the casing during operation so as to substantially prolong service life of the tubular flexible chamber. As the nipple is mounted for axial movement within in the limits of elasticity of the material of the flexible chamber, an additional self-sealing of the latter occurs when fluid under pressure is supplied to the elastic chamber. The higher the pressure in the interior of the chamber, the stronger the pressure clamping the ends thereof between the conical surface of the nipple head and respective conical surfaces of the cylindrical bushings. This rules out a loss of sealing of the interior of the flexible chamber under high pressures.

The absence of the rings results in an increase in the stroke of the parting halves of the casing so as to enhance efficiency of the powered member in operation and general efficiency thereof.

This construction of the powered member results in an increase in the stroke of the parting halves of the casing. The latter results in a reduction of time for a fracture to develop in a direction of a preset splitting plane. The powered member according to the invention is advantageous in a simple design so that it becomes more reliable in operation. In addition, an increase in wall thickness in each end part of the casing results in a still greater enhancement of reliability of the powered member in operation.

The reduced number of parts of which the powered member is made results in a cut-down time for its preparation for operation and ensures a high degree of repairability.

It is expendient that two cylindrical bushings be interconnected by means of radially extending fasteners.

This construction of the powered member enhances its reliability in operation as the bushings can axially move upon pressure supply within the limits of elasticity of the fasteners material, and an annular microclearance appearing upon the tension of the parting halves of the casing is made up for by pressure of the end faces of the bushings against the walls of the annular grooves of the casing.

The powered member according to the invention develops a force of about 60,000 kg with a weight of 1 kg, diameter of 30 mm and length of 300 mm, the power developed per unit of mass being 5–10 times as great as in best devices available in the world used for developing a directional force. Thus, a hydraulic splitter which is now widely used in the mining industry and construction which develops a force of up to 150 tons in boreholes of 40 to 45 mm in diameter weighs 25 kg, and the powered member according to the invention develops a splitting force of 150 tons with the same diameter of a borehole and weighs only 2.5 kg.

The powered member according to the invention is easy to manufacture, it does not require short-supply structural materials and sophisticated manufacturing equipment, features simplicity of maintenance and high repairability.

BRIEF DESCRIPTION OF THE DRAWINGS

Other objects and advantages of the invention will become apparent from the following specific embodiment illustrated in the accompanying drawings, in which.

DESCRIPTION OF THE PREFERRED EMBODIMENT

Figure 1:
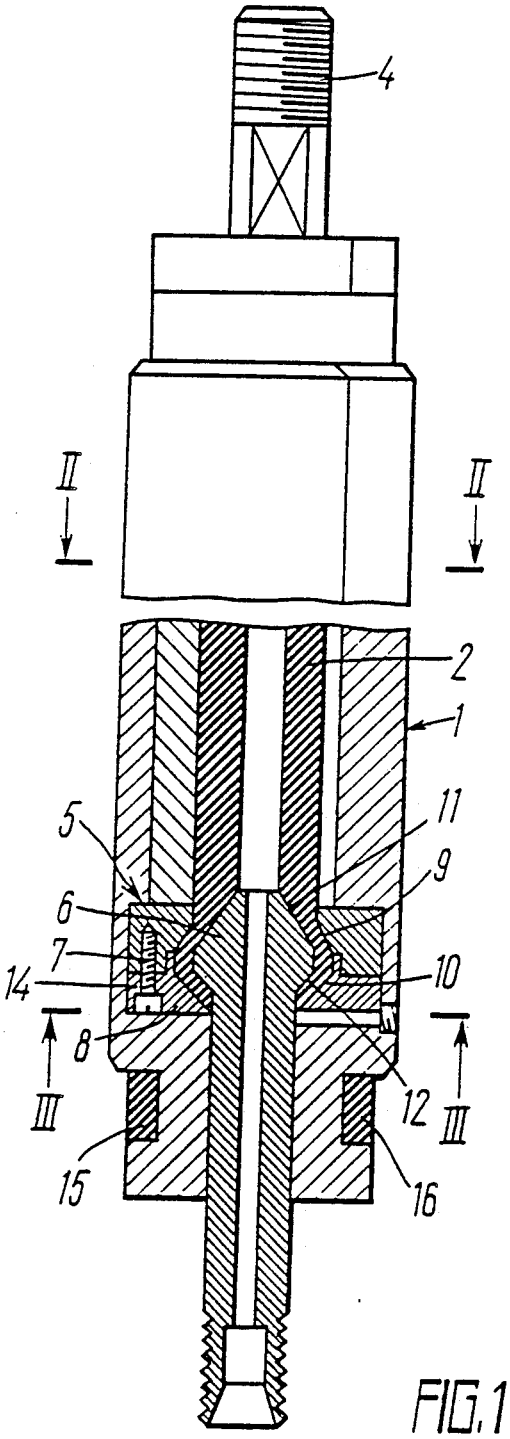
FIG. 1 schematically shows a powered member according to the invention, partially in longitudinal section.
Figure 2:
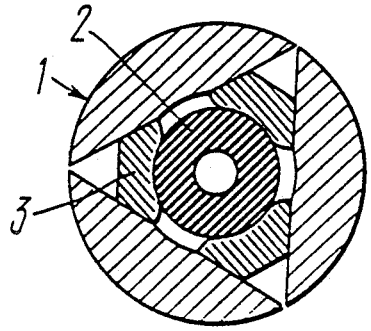
FIG. 2 is a sectional view taken along line II—II in FIG. 1f
Figure 3:
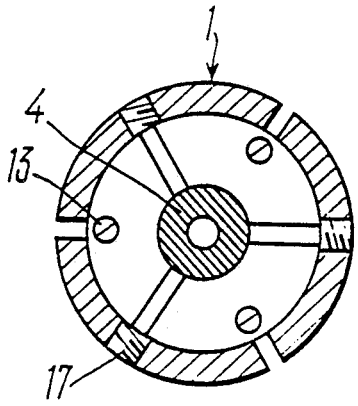
FIG. 3 is a sectional view taken along line III—III in FIG. 1.

A powered member according to the invention, which is designed, e.g. for working quarries of natural stone by stripping-off large-size blocks from the rock mass along a line of boreholes with their subsequent splitting into blocks, comprises a casing 1 which is in the form of axially parting casing (FIG. 1) accommodating a coaxially mounted flexible tubular chamber 2 and spacer inserts 3 (FIG. 2), each being located on the side of the parting plane of the casing 1 and in a plane perpendicular with respect to the axis of the casing 1, and is of a trapezoidal cross-section, the larger base of the trapezium bearing against the flexible tubular chamber 2 and the sides bearing against the inner surface of the wall of the casing 1. Two nipples 4 (FIG. 1) are provided for supplying fluid to the interior of the flexible tubular chamber 2 and for air escape from the latter, the nipples being located on the side of the end faces of the casing 1 for movement along the longitudinal axis thereof. The powered member is provided with a means 5 for attaching each end of the flexible tubular chamber 2 to head 6 of the nipple 4. This means 5 is formed by a pair of cylindrical bushings 7 and 8 connected to each other by means of a tenon and mortise joint, which are positioned in the casing 1 and define a central passage having its axis aligned with the axis of the casing 1. The tenon and mortise joint here means an annular shoulder on the cylindrical bushing 8 and an annular groove in the cylindrical bushing 7. Each wall 9 and 10 of the passage is a generatrin of a truncated cone in a plane drawn in parallel with the longitudinal axis of the casing 1. the two truncated cones are positioned with their larger bases facing towards each other. The wall 9 of the passage extends substantially in parallel with a generatrin 11 of one conical surface of the head 6 of the nipple 4 and the other wall 10 of the passage extends substantially in parallel with a generatrix 12 of another conical surface of the head 6 of the nipple. The cylindrical bushings 7 and 8 are connected to each other by means of longitudinally extended fasteners 13 (FIG. 3). The casing 1 has an annular groove 14 (FIG. 1) which receives the cylindrical bushings 7 and 8. Annular depressions 15 in the outer periphery of the parting casing 1 receive flexible rings 16. Guide pins 17 (FIG. 3) are provided for ensuring uniform movement of the halves of the casing 1 in the radial direction upon elastic deformation of the flexible tubular chamber.

The powered member functions in the following manner. When fluid is supplied through the nipple 4 (FIG. 1) into the interior space of the flexible tubular chamber 2, the latter expands, and the force is transmitted to the parting halves of the casing 1 directly both on the part of the flexible tubular chamber 2 and spacer inserts 3. Under the action of fluid in the interior space of the flexible tubular chamber 2 the nipple 4 moves axially within the limits of elasticity of the material of the flexible chamber 2 to ensure self-sealing of the ends of the flexible chamber 2, namely by clamping them between conical surfaces of the head 6 of the nipple 4 and conical surface of the cylindrical bushings 7 and 8. The end face of each of the bushings 7 and 8 prevents a microclearance from forming between the end faces of the spacer inserts 3 and the parting halves of the casing 1 thereby preventing the flexible chamber 2 from "flowing out". When working pressure drops to zero, all movable parts of the powered member return to the initial position under the action of flexible rings 16.

The present invention may be most advantageously used for stripping off large-size blocks of natural stone along a line of boreholes and for their subsequent splitting into blocks, for non-explosive driving of mining workings in hard rocks, for demolishing foundations of old buildings and other strong structures. The powered member according to the invention when used in boreholes may find application in weakening hard to collapse roof in working sheet deposits, for positive degassing of coal seams, for fracturing oil and gas formations, investigations of stress-strain state of a rock mass under field conditions and as a powerful compact power drive for actuator members of presses, jacks, guillotines and other devices where it is necessary to develope substantial directional forces.

The powered member according to the invention weighing 1 kg and having the diameter of 30 mm and length of 300 mm develops a force of about 60,000 kg, the power developed thereby per unit of mass being 5–10 times as great as that of best devices in the world designed for developing a directional force. Thus, a hydraulic splitter widely used nowadays in the construction which develops splitting force of up to 150 tons in boreholes 40–50 mm in diameter weighs 25 kg, and the powered member according to the invention, designed for boreholes of similar diameter, develops a force of 150 tons and weighs only 2.5 kg.

The powered member according to the invention is simple in the manufacture, is compact, does not require short-supply structural materials and sophisticated equipment, and features easy maintenance and high repairability.

I claim:

1. A powered member, comprising: an axially parting casing accommodating a coaxially mounted flexible tubular chamber, spacer inserts, each of said inserts being located on the side of the parting plane of the casing and in a plane perpendicular with respect to an axis of the casing and being shaped as a trapezoidal cross-section with a larger base bearing against the flexible chamber and sides bearing against an inner surface of a wall of the casing, a pair of nipples for supplying fluid to the interior of the flexible tubular chamber and for air escape therefrom, said nipples being mounted on sides of end faces of the casing for movement along the longitudinal axis thereof, and a means for attaching each end of the flexible chamber to a head of the nipple, said means for attaching each end of the flexible tubular chamber to the head of the nipple being formed by a pair of cylindrical bushings which are interconnected by means of a tenon and mortise joint, said bushings being located in the casing, and defining a central passage having an axis aligned with the axis of the casing, the walls of the passage in a plane drawn in parallel with the longitudinal axis of the casing being in the form of a pair of truncated cones having their larger bases facing towards each other, one generatrix of the conical surface of the passage extending substantially in parallel with the generatrix of one conical surface of the head of the nipple and the other generatrix of the passage extending substantially in parallel with the generatrix of the other conical surface of the head of the nipple.

2. A powered member according to claim 1, wherein the two cylindrical bushings are interconnected by means of longitudinally extended fasteners.

* * * * *